United States Patent [19]

Wise

[11] Patent Number: 4,541,313

[45] Date of Patent: Sep. 17, 1985

[54] ADJUSTABLE TORQUE WRENCH

[75] Inventor: Douglas F. Wise, Wardington, Nr Banbury, England

[73] Assignee: Norbar Torque Tools Limited, Banbury, United Kingdom

[21] Appl. No.: 551,729

[22] Filed: Nov. 15, 1983

[51] Int. Cl.[4] ..... B25B 23/142

[52] U.S. Cl. ..... 81/478

[58] Field of Search ..... 81/478

[56] References Cited

U.S. PATENT DOCUMENTS 3,355,970 12/1967 Knudsen et al. ..... 81/478

FOREIGN PATENT DOCUMENTS 856782 8/1981 U.S.S.R. ..... 81/478

*Primary Examiner*—James G. Smith

*Assistant Examiner*—J. T. Zatarga

*Attorney, Agent, or Firm*—Emory L. Groff, Jr.

[57] ABSTRACT

A tool, such as the torque wrench shown, has a fixed tube 2 and rotatable coaxial handle 9 which serves to move nut 5 longitudinally by means of screw 6, thus adjusting the compression of spring 4. The torque value is indicated by a scale 14 rotatable in housing 11 and viewable through window 13 which includes a cursor. The scale 14 is an extension of the dynamic spline 16 fixed to the tube 2 and wave generator comprising two flats 18, on the end 10 of handle 9, which press the splines into engagement at discrete locations. For every revolution of handle 9 the scale on member 14 will be moved a distance corresponding to one tooth pitch where the difference in the number of teeth 16 and 15 is one.

4 Claims, 3 Drawing Figures

ADJUSTABLE TORQUE WRENCH

BACKGROUND OF THE INVENTION

This invention relates primarily to adjustable torque wrenches but may be used with other tools and is concerned with an arrangement for indicating by means of a scale the torque value to which the wrench is adjusted. The adjustment being effected by rotation of one member relative another.

FIELD OF THE INVENTION AND PRIOR ART

Torque wrenches, as are known, have a body forming an arm with a work engaging member or drive at one end which receives a socket or other tool and arranged so that the mechanism "clicks" or otherwise indicates when more than a set torque is applied through the arm. The torque is made adjustable through a spring acting on a lever mechanism associated with the drive and the spring force is made variable through an adjusting nut. The nut is associated with some form of linear scale along the body to indicate the torque value set. Such a scale is too short to read accurately and it is often impracticable to accomodate dual scales.

An object of this invention is to provide in a tool such as a torque wrench with a relatively long scale which can be accurately and easily read, yet which is of simple construction and which can be located around the circumference of a handle or arm of the tool.

SUMMARY OF THE INVENTION

According to this invention there is provided an improved torque wrench which comprises an elongate tubular handle one end of which has a tube coaxial with and overlying the handle to form a hand grip rotatable with respect to the handle. A screw threaded member extends within the handle at said one end and is connected so as to be rotatable with said tube. A nut on the screw threaded member is restrained against rotation relative to the handle but is longitudinally movable in the handle. The nut forms a means to adjust the compression of a spring acting on one end of a lever arm which extends along the tubular handle and is connected with a work engaging member at the other end of the handle. The spring maintains the lever arm in a first stable position. Application of torque through the handle to the workpiece which exceeds a value set by compression applied to the spring by the nut, causes the lever arm to pivot to a second unstable position to provide indication of the set torque loading. The arm thereafter returns to the first stable position on release of the torque load. The specific improvement of the invention comprises a scale means to indicate the torque loading set by the compression of the spring, the scale means being positioned concentrically around the handle. The scale means has a first dynamic splined member rotatable within an end of the hand grip and a second fixed splined member secured to the handle. The splined members are positioned one within the other with the number of splines on each respective spline member differing. The end of the hand grip has a flat or flats engaging a portion of the peripheral surface of the dynamic spline to force the same to engage with the fixed spline, the dynamic spline being associated with a scale rotatable relative to an indicator.

With such an arrangement the so called harmonic drive formed by the spline members provides a compact means of reducing the number of turns of the rotatable tube by a ratio enabling the scale to be accommodated around the circumference of the body of the handle.

The basis of operation of the harmonic drive is the difference in the tooth pitch between two annular splines, one being movable and flexible (the dynamic spline) and the other being rigid and fixed. The dynamic spline is forced into engagement with the fixed spline at one or more locations by a so-called wave generator. Thus in one revolution of the wave generator which is conveniently connected with the rotatable tube, the scale connected with the dynamic spline is displaced by one tooth pitch.

The cursor and fixed spline are connected with the handle of the wrench with the dynamic spline concentric therewith and having an axial extension forming the scale lying beneath a window in a housing positioned around the handle and connected with the fixed spline. The end of the tube is rotatably received in the housing, and has an inner circumference forming the wave generator which overlies the dynamic spline with a portion of reduced diameter to force same into engagement at one or more discrete locations with the fixed spline.

The invention is further described and illustrated with reference to an embodiment shown in the accompanying drawing by way of example only. In the drawings:

DESCRIPTION OF PREFERRED EMBODIMENT

Figure 1:
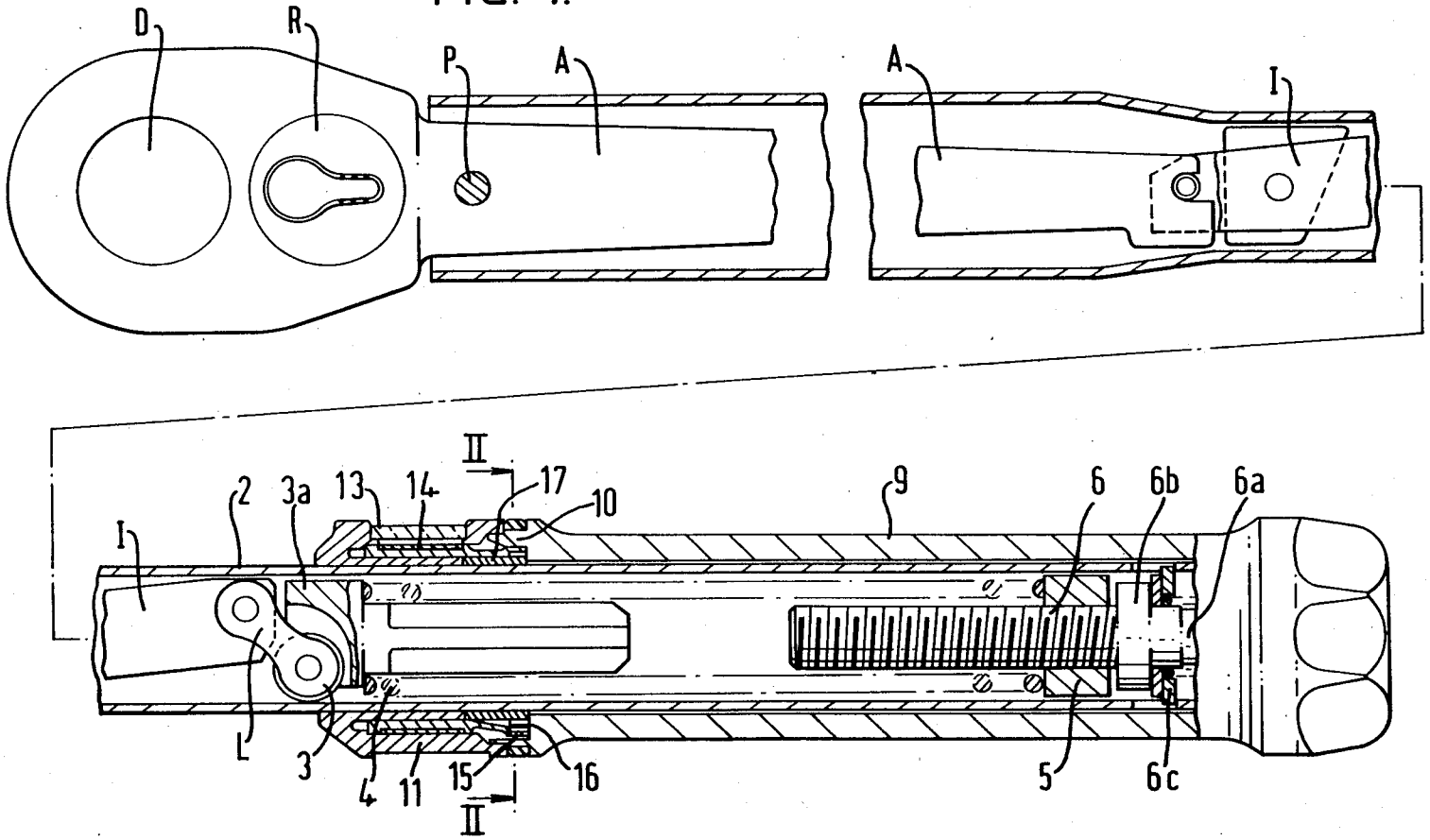
FIG. 1 shows a torque wrench handle in longitudinal section.

Referring to the drawings, a torque wrench is shown and this includes a tubular handle 2 which, at the left end, has a square work engaging drive D retained against rotation in the one direction or the other by a ratchet means R and which is pivotally mounted in the end of tube 2 by a pin P. The drive D has an arm A which extends along tubular handle 2 to connect via a knuckle joint J with a further lever arm I having a linkage L carrying a roller 3 which is subject to force from one end of spring 4 which acts on roller 3 via block *3a*. The other end of spring 4 is contacted by a moving abutment nut 5 which can be traversed longitudinally by rotation of lead screw 6. Grooves (not shown) in the nut 5 run on raised flutes (not shown) in the bore of the tube 2, thus preventing rotation of the nut relatively thereto. An outer hand grip tube 9 is coaxial with the handle 2 and relatively rotatably mounted thereon and connected to screw 6 by a stub *6a* with a flange *6b* abutting circlip *6c* serving to retain the hand grip and screw in handle 2. Hand grip 9 may be rotated along with screw 6 to adjust the compression applied to spring 4 by nut 5 and hence the release torque. With this construction torque applied above a value determined by the precompression of spring 4 is sufficient to pivot arm A about pin P by deflection of spring 4 through roller 3 thus providing a physical and audible signal as the lever train A, I, L snaps-over.

Figure 2:
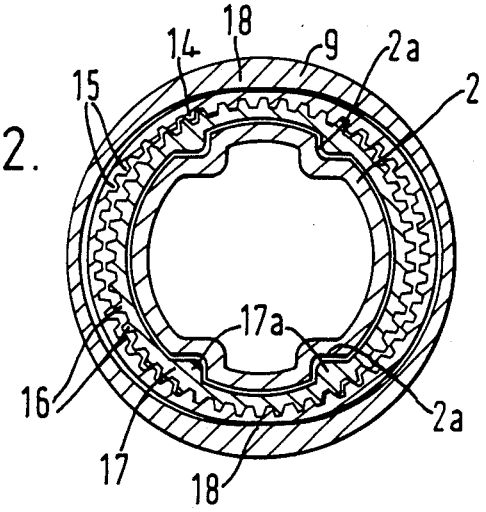
FIG. 2 is a section on 11—11 of FIG. 1.
Figure 3:
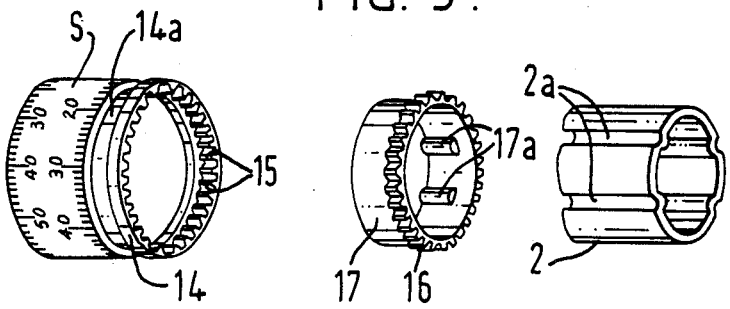
FIG. 3 shows the harmonic drive components in longitudinally exploded view.

The end 10 of hand grip 9 is received in a housing 11 secured to handle 2 by four raised lugs *17a* fitting in grooves *2a* of the handle 2 (FIGS. 2 and 3) and the housing 11 has a window 13 enabling a scale S around the periphery of an annular movable member 14 to be viewed. This member 14 comprises or is connected to a first dynamic or rotatable spline part of a harmonic drive and has teeth 15 around the inner circumference which normally do not engage and are free of a further set of teeth 16 comprising a second fixed spline 17 mounted on the tube 2 and keyed thereto by lugs 17*a* engaging the grooves 2*a* of the tube 2. The number of teeth 16 on fixed spline 17 differ from the number on the dynamic spline 14, and by means of a wave generator defined by two opposed flats 18 on the end 10 of the handle 9 teeth 15 are forced to engage teeth 16 at two opposed points and by virtue of the flexibility of spline 14 as shown engaged at the top and disengaged at the bottom for convenience only, normally the two flats engage the teeth at diametrically opposed points. As shown in FIG. 3 the part of moving member 14 carrying teeth 15 is made flexible and connected with the part carrying the scale by a joining bridge 14*a* which takes up deformation applied to the teeth without deforming the scale carrying part. The scale is fully supported on both sides by the housing 11 which is formed with a cylindrical elongate slot to receive the scale.

For every revolution of handle 9 the scale on member 14 will be moved a distance corresponding to one tooth pitch where the difference in the number of teeth 16 and 15 is one.

The scale can thus provide an accurate indication of torque settings even when the number of revolutions over the adjustment range is high and is easily viewed.

In the embodiment shown the dynamic spline 15 has 48 teeth and the fixed spline 17 has 46 teeth. The dynamic spline is of a flexible plastics material and with each revolution is moved by half the tooth pitch and provides an effective gear ratio of 23:1.

Although the invention is described in relation to torque wrenches, it may be equally applied to other devices requiring a scale indication where a number of revolutions of an adjusting nut are provided such as in micrometer type instruments or the like.

I claim:

1. An improved torque wrench comprising an elongate tubular handle one end of which has a tube coaxial with and overlying the handle, the tube forming a hand grip rotatable with respect to the handle, a screw threaded member extending within the handle at said one end and connected to be rotatable with said tube, a nut on the screw threaded member restrained against rotation relative to the handle but longitudinally movable in said handle, the nut forming a means to adjust the compression of a spring acting on one end of a lever arm, extending along the tubular handle and connected with a work engaging member at the other end of the handle, the spring maintaining the lever arm in a first stable position, application of torque through the handle to the workpiece and exceeding a value set by compression applied to the spring by the nut causing the lever arm to pivot to a second unstable position to provide indication of the set torque loading, the arm thereafter returning to the said first stable position on release of the torque load, wherein the improvement comprises a scale means to indicate the torque loading set by the compression of the spring, the scale means being positioned concentrically around the handle and having a first dynamic splined member rotatable within an end of the hand grip and a second fixed splined member secured to the handle, the splined members being positioned one within the other, the number of splines on each respective spline member differing, the end of the hand grip having a flat or flats engaging a portion of the peripheral surface of the said dynamic spline to force same to engage the said fixed spline, the said dynamic spline being associated with a scale member rotatable relative to an indicator.

2. A torque wrench in accordance with claim 1, wherein the scale member is a tubular extension of the dynamic spline and is housed within an annular end part of the hand grip connected with the tube, said end part having a window therein to view the scale member and a cursor cooperating with the scale member.

3. A torque wrench in accordance with claim 2, wherein the annular end part has inner and outer concentric annular portions defining therebetween an annular slot which receives the scale member, the inner annular portion forming a contiguous cylinder with the fixed spline and both being keyed to the tubular member by complementary engaging formations.

4. A torque wrench in accordance with claim 3, wherein the dynamic spline is housed within a widened end of said annular end part, said widened end forming a mouth to receive an end portion of the rotatable hand grip, said end portion receiving the dynamic spline and including the flat or flats.

* * * * *